United States Patent [19]

Vind

[11] 3,981,075

[45] Sept. 21, 1976

[54] METHOD OF MAKING HIGH-DUTY PTC-RESISTOR

[75] Inventor: Holger Wilhelm Vind, Nordborg, Denmark

[73] Assignee: Danfoss A/S, Nordborg, Denmark

[22] Filed: Oct. 14, 1975

[21] Appl. No.: 621,745

Related U.S. Application Data

[62] Division of Ser. No. 521,244, Nov. 6, 1974.

[30] Foreign Application Priority Data

Nov. 14, 1973 Germany ..... 2356765

[52] U.S. Cl. ..... 29/612; 29/621; 29/420; 29/420.5

[51] Int. Cl.[2] ..... H01C 7/02; H01C 7/04

[58] Field of Search ..... 29/610, 612, 621, 420, 29/420.5; 338/13, 22, 23, 24, 25; 307/310

[56] References Cited

UNITED STATES PATENTS

| | | | |
|---|---|---|---|
| 2,358,211 | 9/1944 | Christensen et al. | 338/22 R |
| 2,937,354 | 5/1960 | Mazzarella et al. | 338/22 R |
| 3,340,490 | 9/1967 | Obenhaus | 338/25 X |
| 3,742,419 | 6/1973 | Martzloff | 338/22 X |

*Primary Examiner*—Victor A. Dipalma

[57] ABSTRACT

A method for making a heavy duty PTC resistor with a pressed and sintered hollow cylindrical body of a ceramic composition which has two end faces in a radial plane with a connection contact on each end face.

2 Claims, 3 Drawing Figures

METHOD OF MAKING HIGH-DUTY PTC-RESISTOR

This is a Divisional Application of patent application Ser. No. 521,244 filed Nov. 6, 1974.

The invention relates to a high-duty PTC-resistor with a pressed and sintered body of a ceramic composition which has two end-faces carrying a connection contact; the invention also concerns a method of manufacturing such PTC-resistor.

High-duty PTC-resistors are required for some purposes. If for example a PTC-resistor is used as a starting device for a single-phase motor, it has to be designed to deal with almost the entire mains voltage and to carry power of 500 W or more. The usual cylindrical bodies, provided at their two end-faces with connection contacts, frequently exhibit cracks under loads of this kind.

A high-duty PTC-resistor is thus known (German patent specification OS 1,465,349) which is made up of a stack of solid or hollow flat cylindrical discs, the end-faces of the superposed discs being interconnected by a contact layer.

The object of the present invention is to provide a high-duty PTC-resistor of the initially described kind in which larger bodies can be used without the occurrence of cracks under load.

According to the invention, this object is achieved in that the end faces extend in the direction of the force with which the body was loaded during pressing.

Surprisingly, it has been found that the raw material is compacted to differing extents during pressing prior to sintering. Partly on account of the friction within the powdered material itself and partly because of the friction between the powdered material and the wall of the mould, the material is compacted to a greater extent near the ends of the body to which the pressure is applied than in the median zone. A kind of division of the layers therefore occurs in the transverse direction. If, as previously, current passes successively through these different layers, a greatly differing power distribution and therefore thermal loading in the various layers is achieved so that the formation of cracks is promoted. If, on the other hand, the end-faces provided with the connecting contacts extend in the direction of the force applied during pressing, the various layers of differing density are disposed parallel to each other. Consequently a stable coupling of the layers, which are arranged in parallel and which are all affected by the same voltage, is achieved. The end-faces reach the same temperature at both sides so that thermal equalization can also take place through the connecting contacts. In addition, it is possible, by varying the height of the body, to vary the resistance while using the same material and press tool, without thereby reducing the dielectric strength in the direction of current-flow.

In a preferred arrangement in which use is made of an element in the form of a sector of a hollow cylinder, the end-faces, provided with the contact layer, are formed by those faces of the sector of the hollow cylinder that lie in the radial planes. In this way and in contrast to bodies in the form of flat plates, very stable PTC-resistors are obtained even when the elements are relatively thin-walled.

Particular advantage is achieved if two halves of a hollow cylinder are interconnected with contacts, extending in a diametral plane, fitted between them. This results in a homogeneous stable hollow cylinder in which however the current flows transversely to the direction in which pressing has been carried out.

In accordance with a further feature, the connecting contacts consist of metal pieces, e.g. plugs, which are applied to a contact layer and project beyond the body.

A method of manufacturing a PTC-resistor consists in pressing a body in the form of a hollow cylinder and halving it in the longitudinal direction, and in sintering the two halves, providing them with a contact layer and uniting them, with connecting contact pieces interposed between them.

The invention will now be described in greater detail with reference to an embodiment illustrated diagrammatically in the attached drawing, in which.

Figure 1:
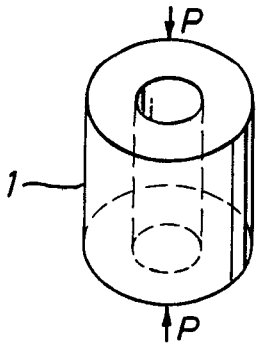
FIG. 1 shows a body in the form of a hollow cylinder, after pressing.
Figure 2:
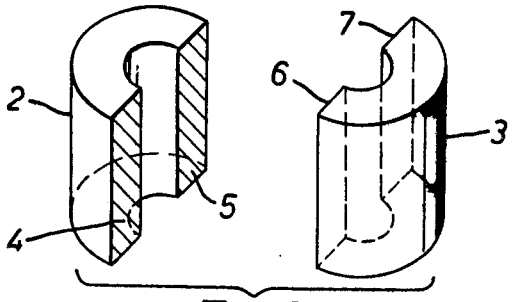
FIG. 2 shows the two halves of the body after sintering and application of the contact layer.
Figure 3:
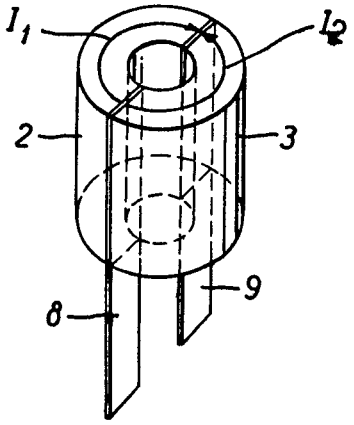
FIG. 3 shows the finished PTC-resistor.

FIG. 1 shows a body 1 of ceramic material and in the form of a hollow cylinder. The two arrows P indicate the direction in which pressing has been carried out, i.e. the direction in which the body has been loaded by pressure in its mould. The material is that normally used for PTC-resistors, for example barium titanate or another metallic oxide or metallic salt.

The body 1 pressed in this way is halved in the longitudinal direction to provide two halves 2 and 3. These halves are sintered, and their cut faces are each provided with a contact layer 4, 5, 6 and 7, consisting of silver for example. Finally, the two halves 2 and 3 are soldered together, with two contact pieces 8 and 9 interposed between them. These contact pieces may take the form of plugs, or they may serve as contact vanes.

When a direct-current voltage is applied to the connector 8 of the positive pole and the terminal 9 of the negative pole, the current $I_1$ flows in the half 2 and the current $I_2$ in the half 3 in the direction indicated by the arrows. This direction is at right-angles to the direction P in which pressing has been carried out. The disadvantageous consequences of any stratification that may have occurred during pressing are eliminated in this manner.

I claim:

1. A method of manufacturing a PTC resistor comprising the steps of forming a body by pressing it in one direction in a mold, dividing said body in halves along at least one plane which extends parallel to said direction to form end faces in said plane, sintering said halves, applying contact layers to said end faces, interposing contact pieces between said end faces and joining said halves.

2. A method of manufacturing a PTC resistor according to claim 1 wherein said body is initially formed as a hollow cylinder with said direction being parallel to the longitudinal axis of said cylinder.

* * * * *